US008907858B2

(12) United States Patent
Yang et al.

(10) Patent No.: US 8,907,858 B2
(45) Date of Patent: Dec. 9, 2014

(54) INTEGRATED ANTENNAS FOR NEAR FIELD COUPLING INTEGRATION

(75) Inventors: Songnan Yang, San Jose, CA (US); Changsong Sheng, Shanghai (CN)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 13/977,585

(22) PCT Filed: Apr. 11, 2012

(86) PCT No.: PCT/US2012/033117

§ 371 (c)(1), (2), (4) Date: Sep. 29, 2013

(87) PCT Pub. No.: WO2013/154552

PCT Pub. Date: Oct. 17, 2013

(65) Prior Publication Data

US 2014/0203988 A1 Jul. 24, 2014

(51) Int. Cl.

| | |
|---|---|
| ***H01Q 11/12*** | (2006.01) |
| ***H01Q 1/52*** | (2006.01) |
| ***H01F 38/14*** | (2006.01) |
| ***H01Q 7/00*** | (2006.01) |
| ***H01Q 1/22*** | (2006.01) |

(52) U.S. Cl.

CPC ..... *H01Q 1/526* (2013.01); *H01F 38/14* (2013.01); *H01Q 7/00* (2013.01); *H01Q 1/2266* (2013.01)

USPC ..... 343/741; 343/702; 343/787; 343/866

(58) Field of Classification Search

CPC ..... H01F 38/14; H01Q 1/526

USPC ..... 343/702, 741, 742, 787, 788, 866, 867

See application file for complete search history.

(56) References Cited

U.S. PATENT DOCUMENTS

| | | | | |
|---|---|---|---|---|
| 5,826,178 | A * | 10/1998 | Owen | 455/193.1 |
| 6,356,243 | B1 * | 3/2002 | Schneider et al. | 343/866 |
| 6,822,614 | B2 * | 11/2004 | Chiu | 343/741 |
| 7,183,987 | B2 * | 2/2007 | Akiho et al. | 343/742 |
| 7,280,076 | B2 * | 10/2007 | Ninomiya et al. | 343/702 |
| 2012/0162028 | A1 * | 6/2012 | Kubo et al. | 343/702 |

* cited by examiner

*Primary Examiner* — Tho G Phan

(74) *Attorney, Agent, or Firm* — Forefront IP Lawgroup, PLLC

(57) ABSTRACT

Described herein are techniques related to near field coupling and wireless power transfers. In an implementation, a portable device may include full metallic chassis devices. The full metallic chassis devices may include a keyboard and/or trackpad that include a plastic keycap. The plastic keycap may integrate a booster component to increase near field communications (NFC) range of a coil antenna that is integrated onto a surface plane above a circuit board of a switch that is connected to the plastic keycap. In an implementation, a ferrite material is inserted between the coil antenna and the circuit board to protect the coil antenna from Eddy currents that may be induced on a metallic chassis that lie underneath the circuit board.

33 Claims, 8 Drawing Sheets a) NFC Coil Antenna b) Top view of trackpad/ keyboard (c) Cross-sectional view 304 of left touchpad button 226-2

(1) Top view of a portable device keypad (2) Cross-sectional view 202 of space key 204

(1) Top view of a portable device keypad (2) Cross-sectional view 224 of a trackpad 226

INTEGRATED ANTENNAS FOR NEAR FIELD COUPLING INTEGRATION

BACKGROUND

Technologies exist that allow near field coupling (e.g., wireless power transfers (WPT) and near field communications (NFC)) between portable devices in close proximity to each other. Such near field coupling functions may use radio frequency (RF) antennas in the devices to transmit and receive electromagnetic signals. Because of user desires (and/or for esthetic reasons) many of these portable devices are relatively small (and becoming smaller), and tend to have exaggerated aspect ratios when viewed from the side. As a result, many of these portable devices incorporate flat antennas, which use coils of conductive material as their radiating antennas for use in near field coupling functions.

For example, an NFC antenna integration in a plastic chassis portable device may be achieved by creating a cutout on a conductive electromagnetic interference (EMI) coating under a palm rest area of the portable device, such that the NFC antenna that is attached to the cutout area may radiate through the chassis effectively. However, for devices having a complete metallic chassis, the metallic chassis is often used to maintain mechanical strength in a thin design. The use of the metallic chassis creates a key challenge for NFC coil antenna integration into such devices (e.g., thin laptop computers such as Ultrabooks), since the NFC antenna needs a non-metallic surface in order to radiate through.

BRIEF DESCRIPTION OF THE DRAWINGS

FIGS. 5 (*b*) and (*c*) illustrate example magnetic flux operations in a conventional coil and the conventional coil with a magnetic field booster, respectively.

The following Detailed Description is provided with reference to the accompanying figures. In the figures, the leftmost digit(s) of a reference number usually identifies the figure in which the reference number first appears. The use of the same reference numbers in different figures indicates similar or identical items.

DETAILED DESCRIPTION

This document discloses one or more systems, apparatuses, methods, etc. for integrating a near field communications (NFC) coil antenna in a trackpad or keyboard area of a portable device, such as a full metallic chassis laptop computer (e.g., thin computers, such as Ultrabooks). In an implementation, the NFC coil antenna may include a continuous multiple loops of coil antenna to form a ring (rectangular) shaped antenna. The ring shaped coil antenna may include a center cutout in order for the coil antenna to flush into a circuit component of the trackpad or the keyboard area during integration. For example, the circuit component may include a spring support and a switch to implement functionality of a plastic keycap in the trackpad or the keyboard. In this example, the functionality of the spring and the plastic keycap is not affected by the integration of the coil antenna due to the center cutout that is shaped to utilize metal free spaces that may be found available underneath the trackpad or the keyboard. The metal free spaces may include space clearances surrounding the spring support and the switch.

In an implementation, a magnetic field booster may be aligned with the coil antenna to improve NFC range. For example, the magnetic field booster may be integrated or fabricated directly underneath the plastic keycap of the trackpad or the keyboard while the coil antenna is integrated close to or in contact with a circuit board that includes the switch as a circuit component. In this implementation, the magnetic field booster follows the movement of the plastic keycap during operation (e.g., compression) and the magnetic field booster is independent of the coil antenna that may act as a source of magnetic fields. The magnetic field booster may be tuned to be resonant near operating frequency of the coil antenna in order to concentrate magnetic fields generated by the coil antenna. To this end, the combination of coil antenna and a magnetic field booster may have higher quality factor (Q) than the coil antenna alone, which improves the NFC range when detecting NFC tags or similar devices.

In an implementation, a ferrite material may be inserted underneath the coil antenna to protect magnetic fields generated by the coil antenna from reactive field caused by Eddy currents that may be generated by the same magnetic field that is applied to metallic chassis of the portable device. For example, the ferrite material is inserted between the coil antenna and the circuit board to block the magnetic fields that may reach the metallic chassis and prevent Eddy currents from being generated.

Figure 1:
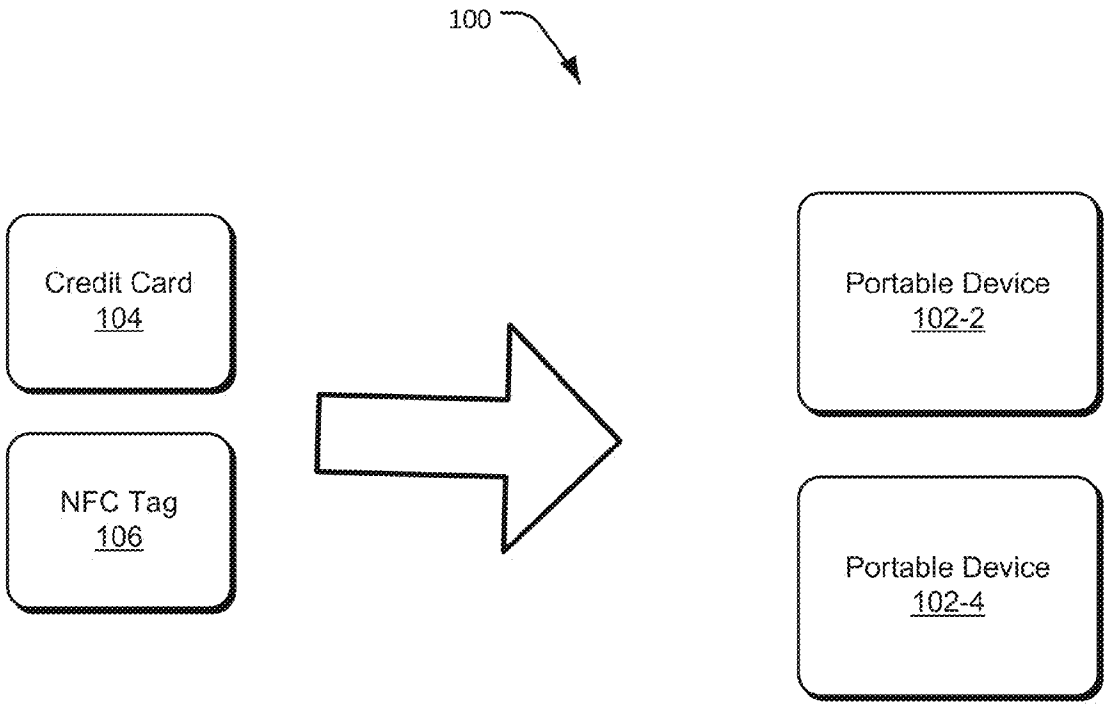
FIG. 1 illustrates portable devices in an example near field coupling arrangement.

FIG. 1 illustrates an example arrangement 100 of portable devices for near field coupling. More particularly, users may have a desire to operate near field coupling enabled portable electronic devices and/or other devices in certain ergonomically convenient manners. Examples of such portable devices include, but are not limited to, Ultrabooks, a tablet computer, a netbook, a notebook computer, a laptop computer, mobile phone, a cellular phone, a smartphone, a personal digital assistant, a multimedia playback device, a digital music player, a digital video player, a navigational device, a digital camera, and the like.

In an implementation, FIG. 1 shows two users using their NFC-enabled portable devices 102-2 and 102-4 to perform NFC-related information sharing functions. For example, a front-to-back or a back-to-back manner may be performed for the NFC communication. In an implementation, the portable devices 102 may accept information from a credit card 104, an NFC tag 106 (or other similar device) through an NFC antenna. The portable devices 102 may require the NFC antenna to be integrated in a trackpad or a keyboard of the portable devices 102. For example, the NFC antenna may be integrated onto a metal free clearance space between a plastic keycap and a circuit component underneath the trackpad or the keyboard. In this example, the portable devices 102 may accept information from a credit card 104 or NFC tag 106 through the NFC antenna.

Figure 2A:
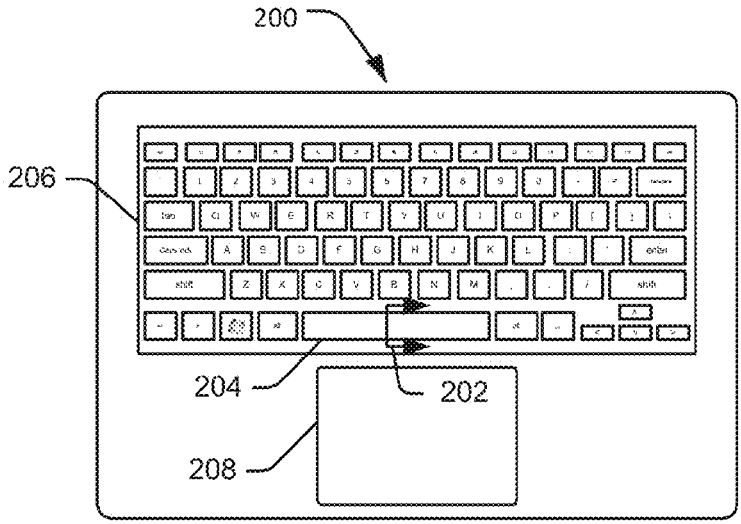
FIGS. 2A (1) and (2) illustrate an example top view of a keypad area in a portable device and a cross-sectional view of a space key, respectively.
Figure 2A:
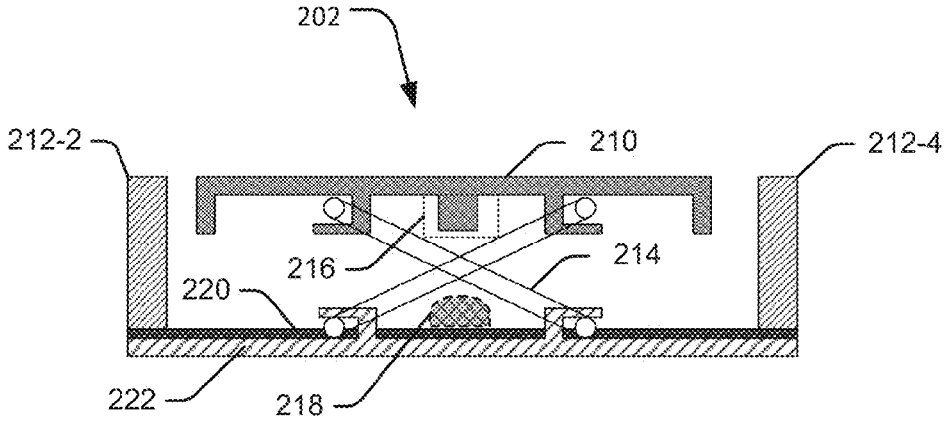

FIGS. 2A (1) and (2) illustrate a top view of a keypad area 200 in the portable device 102 and a cross-sectional view 202 of a space key 204, respectively. In an implementation, the present embodiment may include a unique placement and design of the NFC antenna to enable NFC antenna integration into full metallic chassis device designs, such as Ultrabooks. For example, the NFC antenna may be integrated into or under button assemblies of a keyboard 206 that includes the space key 204. Furthermore, the NFC antenna may be integrated into or under a trackpad 208 that is located below the keyboard 206. In full metallic chassis device designs, a clearance space underneath the buttons of the keyboard 206 or the trackpad 208 may include the only available metal free spaces in the portable device 102.

With continuing reference to FIG. 2A (2), the cross-sectional view 202 of the space key 204 illustrates the clearance space for possible NFC antenna integration. A plastic keycap 210 may be flush with a plane defined by connecting metal chassis surfaces 212-2 and 212-4. Below the plastic keycap 210, a metallic scissor arm mechanism 214 may provide support to the plastic keycap 210. Furthermore, a spring 216 may be placed in-between middle portion of the plastic keycap 210 and a switch 218. The spring 216 may return the plastic keycap 210 to its original location when compressed. In an implementation, the switch 218 may be triggered to provide an electrical input when the plastic keycap 210 is compressed. The switch 218 may be a circuit component of a circuit board 220 that is built from a printed circuit board (PCB), Flexible Printed Circuit (FPC) or Flat Flex Cable (FFC). Under the circuit board 220 is a metallic chassis 222 of the keyboard 206. A distance between the metallic chassis 222 and the plastic keycap 210 may define travelling distance of each key stroke, such as the space key 204. In an implementation, the distance may include few millimeters that are sufficient enough for the NFC antenna (not shown) integration.

Figure 2B:
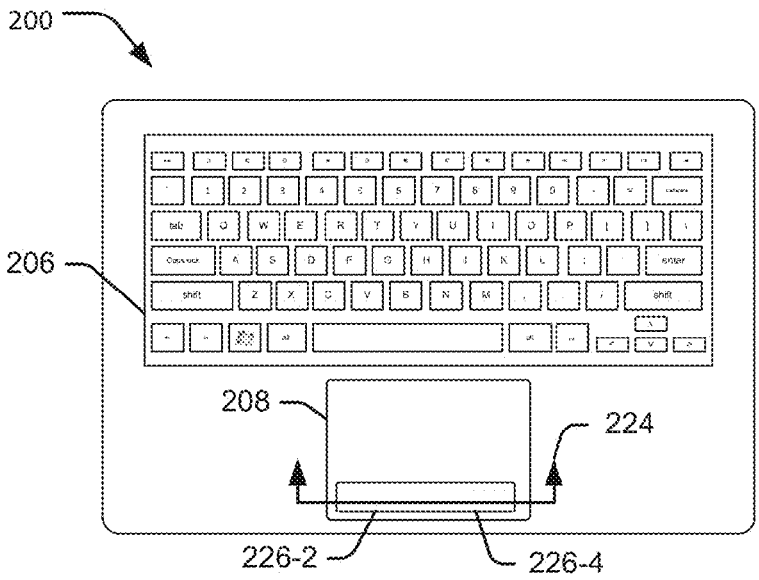
FIGS. 2B (1) and (2) illustrate an example top view of a keypad area in a portable device and a cross-sectional view of trackpad buttons, respectively.
Figure 2B:
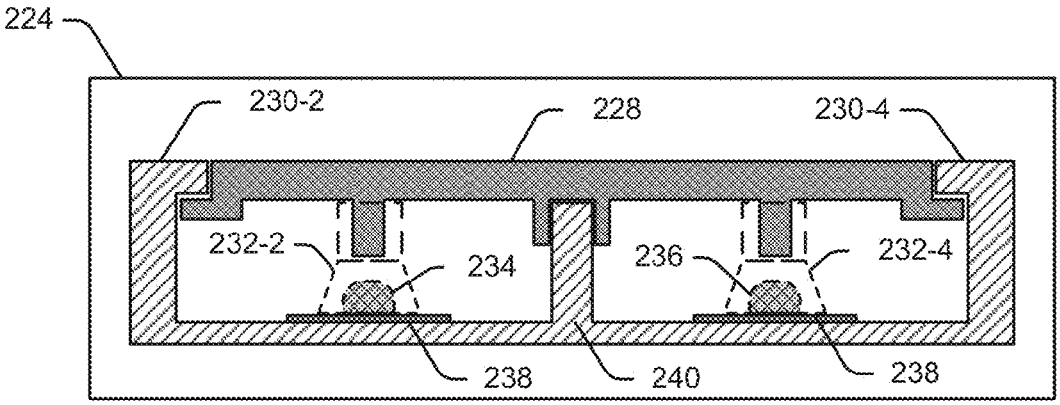

FIGS. 2B (1) and (2) illustrate the top view of the keypad area 200 in the portable device 102 and a cross-sectional view 224 of trackpad buttons 226, respectively. In an implementation, the portable device 102 may include a full metallic chassis device design. The full metallic chassis device design may allow installation of the NFC antenna at the trackpad buttons 226 of the trackpad 208 without compromising functionality of the trackpad buttons 226. The trackpad buttons 226 may include a left touchpad button 226-2 and a right touchpad button 226-4.

With continuing reference to FIG. 2B (2), the cross-sectional view 224 includes a cross-sectional view of the trackpad buttons 226 of the trackpad 208. In an implementation, a trackpad plastic button 228 may be flush with a plane defined by connecting metal chassis surfaces 230-2 and 230-4. In other implementations, the trackpad plastic button 228 may include separate plastic keycaps for the left touchpad button 226-2 and the right touchpad button 226-4. Below the trackpad plastic button 228 is a spring 232-2 that provides mechanical support between the trackpad plastic button 228 and a switch 234. The switch 234 is configured for triggering by the left touchpad button 226-2. Furthermore, a spring 232-4 may be located at another end (i.e., right touchpad button 226-4) of the trackpad plastic button 228. The spring 232-4 may be located in between the trackpad plastic button 228 and a switch 236. The switch 236 may be configured for triggering by the right touchpad button 226-4. In an implementation, both switches 234 and 236 may provide electrical input signals when compressed. The switches 234 and 236 are circuit components of a circuit board 238 that lie near or in contact with bottom chassis 240. In this implementation, the springs 232-2 and 232-4 may push back the trackpad plastic button 228 to its original position when compressed.

Figure 3:
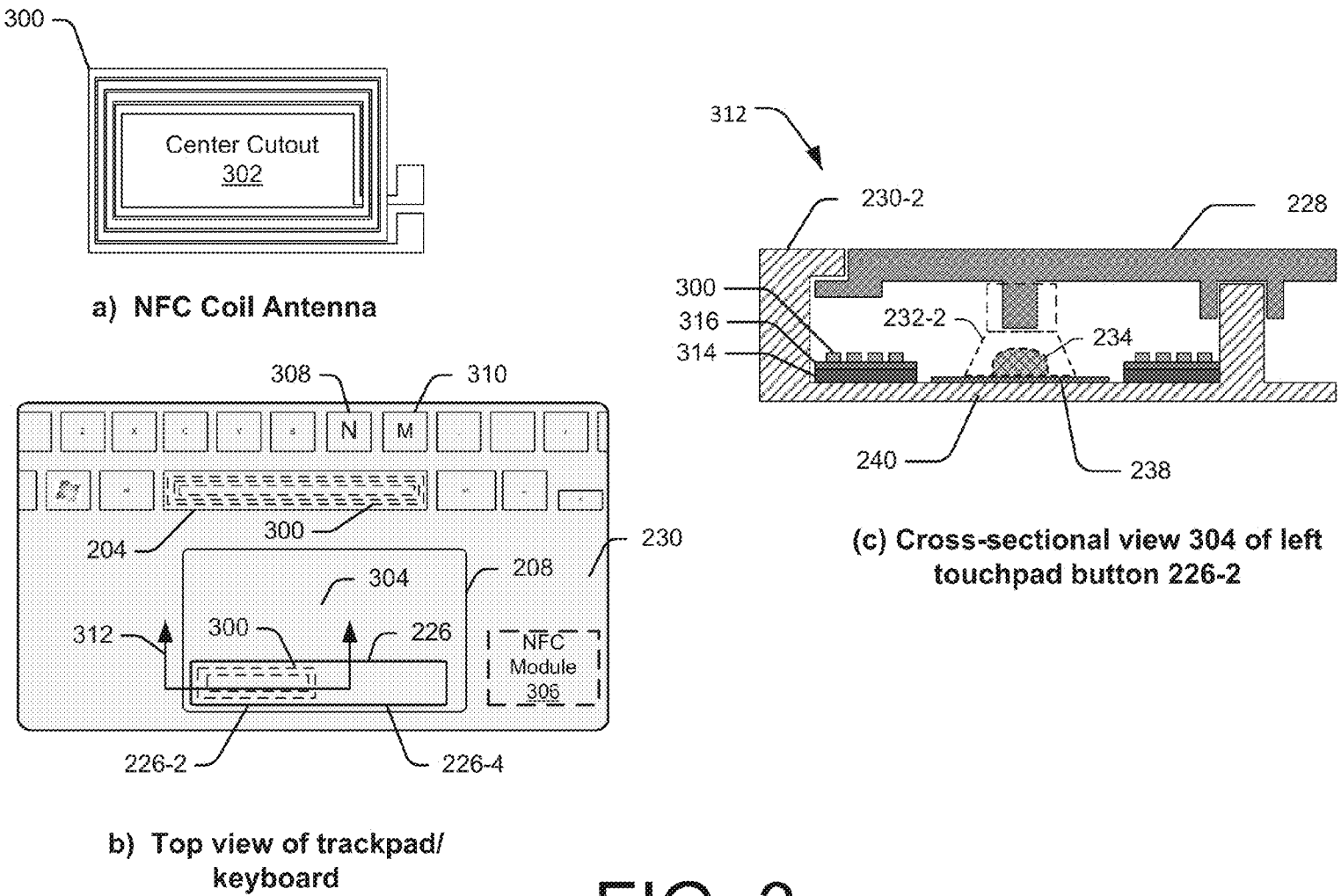
FIG. 3 illustrates an example near field communications (NFC) antenna integration in a fix area underneath a trackpad button of a trackpad.

FIG. 3 (*a*) illustrates a NFC coil antenna 300 that may be integrated to the trackpad buttons 226 or the space key 204. In other implementations, the coil antenna 300 may be integrated to any key buttons (e.g., area underneath plastic keycaps of the space key 204 and one of the keyboard 206 keys) that may located in the keyboard 206. The coil antenna 300 may include a continuous multiple loop of coil antenna that forms a rectangular ring shape with a center cutout 302 at the middle to implement the coil antenna 300 integration to the keyboard 206 or the trackpad 208. The continuous loop of coil antenna 300 may be mounted on, embedded in, or otherwise associated with a ferrite material (not shown). The coil antenna 300 may include a dedicated antenna for NFC and/or WPT purposes. In other words, the coil antenna 300 may be configured to operate on a separate resonant frequency (e.g., 13.56 MHz to implement NFC and/or WPT operations), and independent from another antenna that uses standard frequencies used in wireless communications (e.g., 5 GHz for WiFi signals). The coil antenna 300 may be made out of the PCB, a flexible printed circuit (FPC), a metal wire, created through a laser direct structuring (LDS) process, or directly printed onto the ferrite material.

With continuing reference to FIG. 3 (*b*), the coil antenna 300 may be integrated underneath the space key 204, or underneath the left touchpad button 226-2 of the trackpad buttons 226. In other implementations, the coil antenna 300 may be integrated underneath the right touchpad button 226-4 of the trackpad buttons 226, or integrated underneath middle button 304 of the track pad 208. In other implementations, the coil antenna 300 may be integrated underneath the trackpad 208 and occupy the free spaces defined by at least the left touchpad button 226-2, the right touchpad button 226-4, and/or the middle button 304. For example, the coil antenna 300 may occupy the left touchpad button 226-2 and the right touchpad button 226-4. In other implementations, the coil antenna 300 may be integrated underneath multiple adjacent keys on the keyboard 206, such as underneath adjacent letters "N" 308 and "M" 310. The multiple adjacent keys on the keyboard 206 may include the same physical structures as described with regard to the space key 204 or the trackpad buttons 226. In all of the implementations described above, an NFC module 306 may be integrated anywhere inside the chassis 230 including under the same space key 204, or underneath the track pad 208. The NFC module 306 may include transceiver circuitry that processes electrical signal in the coil antenna 300. For example, the NFC module 306 may be used to provide tuning to the coil antenna 300 for maximum power transfer during transmit or receive operations. In other implementations, the NFC module 306 may be integrated with the coil antenna 300 underneath the trackpad buttons 226 to form a single module. For example, the NFC module 306 may be embedded onto free space available underneath the right touchpad button 226-4.

FIG. 3 (*c*) illustrates a cross-sectional view 312 that includes the coil antenna 300 that lies underneath the trackpad plastic button 228. In an implementation, the coil antenna 300 may be flush onto a surface plane of the bottom chassis 240. In this implementation, the coil antenna 300 may be embedded upon a ferrite material 314 that provides isolation (i.e., protection) between the coil antenna 300 and the bottom chassis 240. Furthermore, the coil antenna 300 may be printed on a PCB substrate 316. The coil antenna 300 integration through the center cutout 302 may allow the trackpad plastic button 228 to trigger the switch 234 and the spring 232-2 to push back the trackpad plastic button 228 to its original position after displacement due to compression. In other implementations, the circuit board 238 may be extended to the area covered by the ferrite material 314. As such, the coil antenna 300 may be exposed at top layer above the circuit board 238, and the ferrite material 314 is inserted between the coil antenna 300 and the circuit board 238 to block Eddy currents that may be generated by the bottom chassis 240. The illustration in FIG. 3 (*c*) may similarly apply when the coil antenna 300 is integrated underneath the space key 204, or underneath the right touchpad button 226-4, or underneath the middle button 304, or underneath multiple adjacent keys of the keyboard 206.

Figure 4:
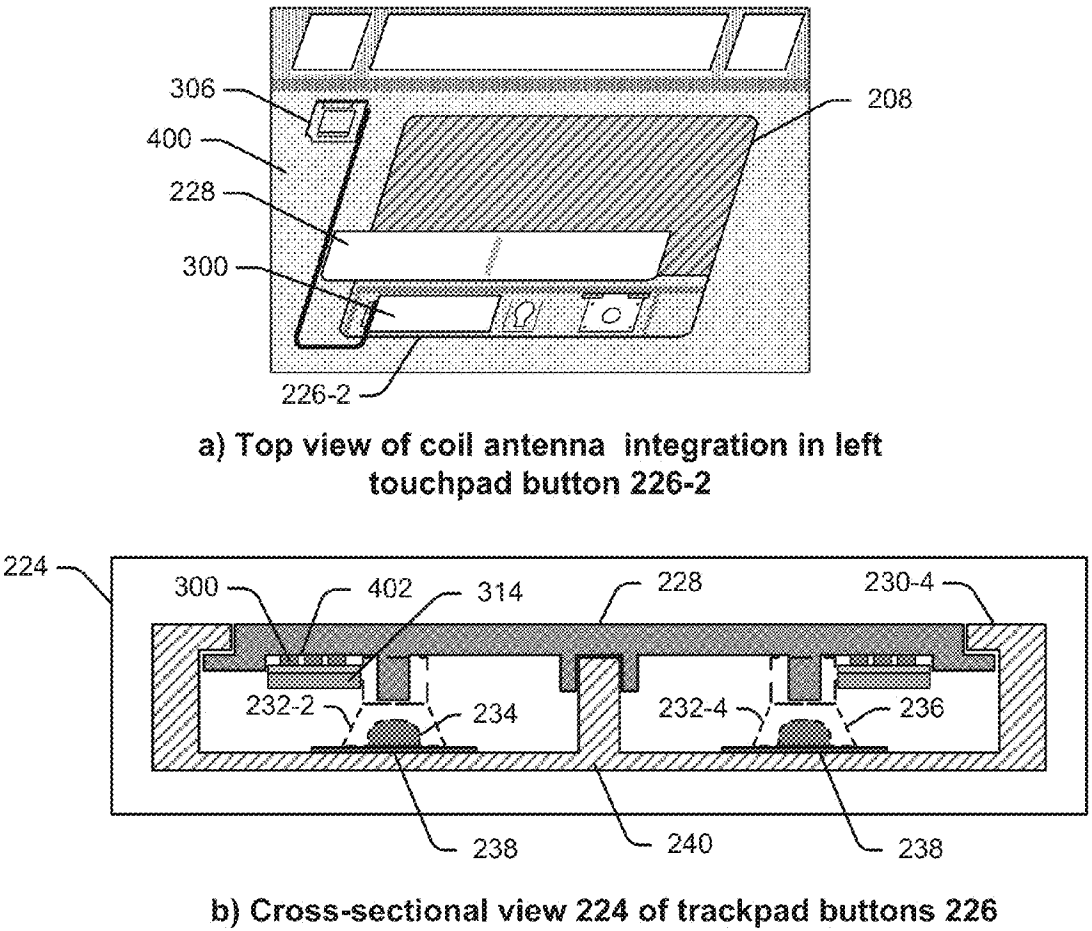
FIG. 4 illustrates an example near field communications (NFC) antenna integration in a trackpad plastic button in a full metallic chassis device design.

FIG. 4 (*a*) illustrates a top view configuration of the coil antenna 300 integration in a full metallic chassis device design. The full metallic chassis device design configuration may allow few millimeters of gap (i.e., space clearance) between the trackpad plastic button 228 and the bottom metal chassis 240 that lies underneath the trackpad plastic button 228. In an implementation, the coil antenna 300 may be fabricated directly into plastic keycap of the trackpad plastic button 228. In this implementation, the NFC module 306 may be separately installed onto palm area 400 of full metallic chassis device 102.

With continuing reference to FIG. 4 (*b*), the cross-sectional view 224 includes the coil antenna 300 that is integrated into movable trackpad plastic button 228. In an implementation, the trackpad plastic button 228 includes a bottom edge 402 that may include outer circumference portions of the trackpad plastic button 228. In this implementation, the coil antenna 300 may flush with the bottom edge 402 while the ferrite material 314 may be inserted between the coil antenna 300 and the bottom chassis 240 to provide isolation from the metal chassis 240 for the coil antenna 300. The center cutout 302 may be shaped to utilize the metal free shapes that surrounds the switches 234 and 236, and the springs 232. In other words, the integration of the coil antenna 300 may not affect the functionality of the switches 234 and 236, and the springs 232.

Figure 5:
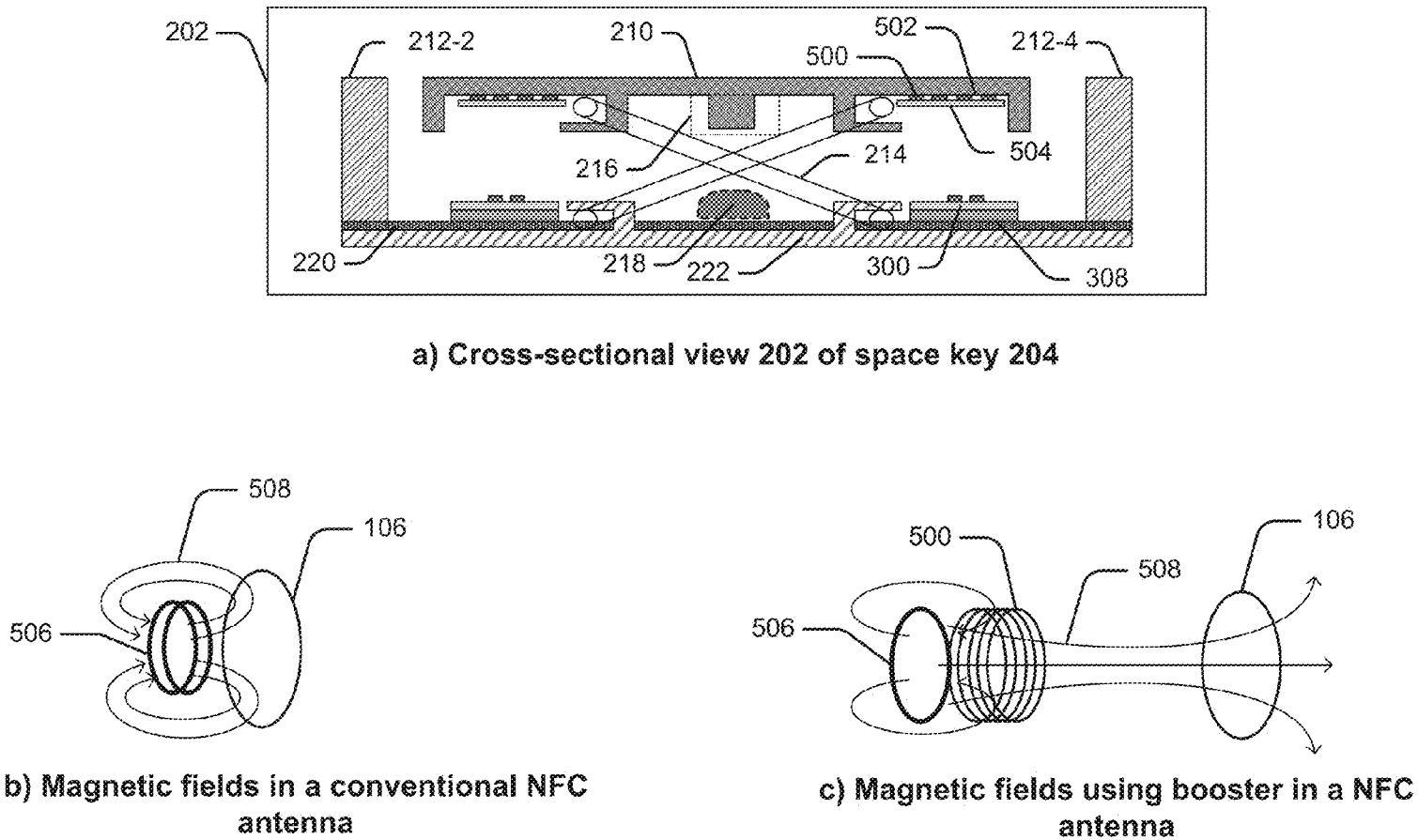
FIG. 5 (*a*) illustrates an example near field communications (NFC) antenna integration with a magnetic field booster that is integrated in a movable plastic keycap of a space key in a keypad.

FIG. 5 (*a*) illustrates the cross-sectional view 202 of the space key 204 that integrates the coil antenna 300 and a magnetic field booster 500. In an implementation, the magnetic field booster 500 may be directly fabricated with the plastic keycap 210 or integrated along an edge 502 of the plastic keycap 210. The edge 502 may include outer circumference of the plastic keycap 210. The magnetic field booster 500 may include parasitic resonant coils that adopt the shape of the coil antenna 300. For example, if the coil antenna 300 is rectangular in shape, then the magnetic field booster 500 may be configured to include rectangular shape. In this example, the magnetic field booster 500 may include a center point (not shown) that is aligned with an inner core (not shown) of the coil antenna 300 such that the shape of the magnetic field booster 500 is lined with the shape of the coil antenna 300. In other implementations, the magnetic field booster 500 may be integrated into the trackpad plastic button 228 while the coil antenna 300 is integrated underneath the plastic button 228. Furthermore, in other implementations, the magnetic field booster 500 may be integrated into plastic buttons (not shown) of multiple adjacent keys (e.g., keys "N" 308 and "M" 310) while the coil antenna 300 is integrated underneath the multiple adjacent keys (e.g., keys "N" 308 and "M" 310) of the keyboard 206.

In an implementation, the magnetic field booster 500 may be capable of offering an improved performance without reliability concerns. For example, the magnetic field booster 500 may be tuned to be resonant near operating frequency to concentrate magnetic fields that are generated by the coil antenna 300. In this example, the magnetic field booster 500 may include parasitic resonant coils that include more number of turns as compared to multiple loops that forms the coil antenna 300. In an implementation, the coil antenna 300 is integrated onto a plane of the circuit board 220 that includes the switch 218 as a circuit component. In this implementation, the coil antenna 300 is aligned with the magnetic field booster 500 to increase NFC range.

FIG. 5 (*b*) illustrates a conventional coil 506 that includes a limited NFC range. For example, the conventional coil 506 may generate a magnetic flux 508 to perform NFC related functions with nearby NFC tag 106. In this example, the magnetic flux 508 is concentrated within the conventional coil 506 and as such, the magnetic flux 508 may provide limited NFC range when performing NFC related functions.

With continuing reference to FIG. 5 (*c*), the conventional coil 506 is aligned with the magnetic field booster 500. For example, the center point of ring shaped resonant coils of the magnetic field booster 500 is lined up with the inner core of the conventional coil 506. In this example, the magnetic flux 508 is concentrated by the magnetic field booster 500 such that the combined magnetic field booster and coil antenna offer an improve quality factor (Q) over the conventional coil 506 alone. The higher Q achieved by the booster 500 may result to a higher current that may be induced on the booster 500 coils, which leads to a stronger magnetic field and a longer communication distance with the NFC tag 106 or other similar devices.

Figure 6:
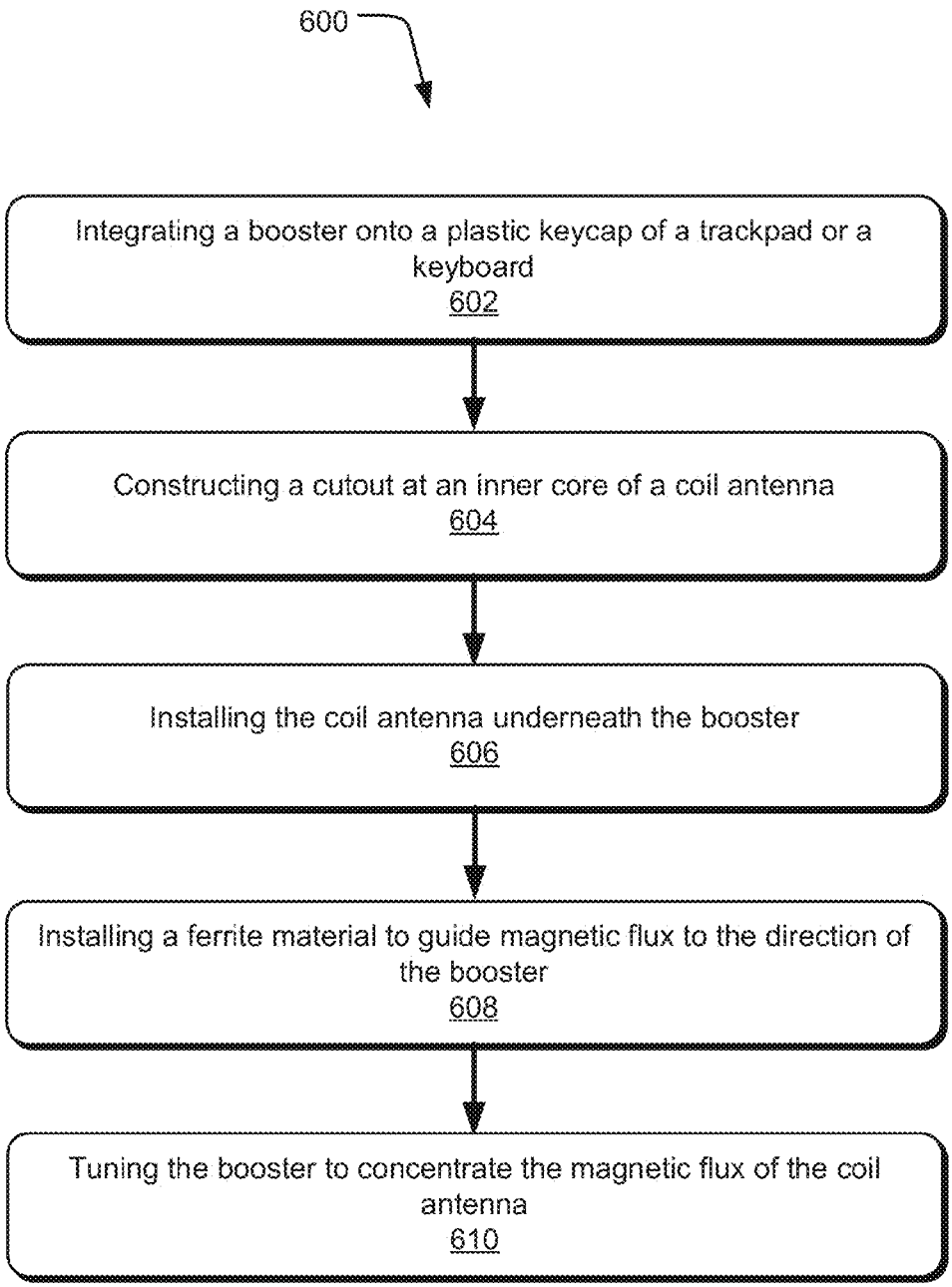
FIG. 6 is an example method for near field communications (NFC) antenna integration in a trackpad or a keyboard to facilitate near field coupling.

FIG. 6 shows an example process chart 600 illustrating an example method for integrating a NFC antenna at a full metallic chassis portable device to facilitate near field communications. The order in which the method is described is not intended to be construed as a limitation, and any number of the described method blocks can be combined in any order to implement the method, or alternate method. Additionally, individual blocks may be deleted from the method without departing from the spirit and scope of the subject matter described herein. Furthermore, the method may be implemented in any suitable hardware, software, firmware, or a combination thereof, without departing from the scope of the invention.

At block 602, integrating a magnetic field booster is performed. In an implementation, the magnetic field booster (e.g., booster 500) may be fabricated directly into a plastic keycap (e.g., plastic keycap 210) of a keyboard (e.g., keyboard 206). In other implementations, the magnetic field booster 500 may be placed along a bottom edge (e.g., edge 502) of the plastic keycap 210. Furthermore, the magnetic field booster may be fabricated directly or placed into trackpad buttons (e.g., trackpad buttons 226) of a trackpad (e.g., trackpad 208), or into multiple adjacent keys (e.g., keys "N" 308 and "M" 310) of the keyboard 206. The magnetic field booster 500 may be independently connected from a coil antenna (e.g., coil antenna 300) that may be integrated separately from the magnetic field booster 500.

At block 604, constructing an inner core cutout in the coil antenna is performed. In an implementation, a cutout (e.g., cutout 302) is removed from an inner core of the coil antenna 300 to utilize metal-free space clearance underneath the plastic keycap 210 the keyboard 206, or underneath trackpad buttons 226, or underneath middle button 304 of the trackpad 208, or underneath multiple adjacent keys (e.g., keys "N" 308 and "M" 310) of the keyboard 206.

At block 606, installing the coil antenna is performed. In an implementation, the coil antenna 300 is installed onto a surface plane of a circuit board (e.g., circuit board 220) that lies underneath the plastic keycap 210 the keyboard 206, or underneath trackpad buttons 226, or underneath middle button 304 of the trackpad 208, or underneath multiple adjacent keys (e.g., keys "N" 308 and "M" 310) of the keyboard 206. For example, the circuit board 220 may include components, such as a switch (e.g., switch 218) that is triggered when the plastic keycap 210 is compressed. In an implementation, the continuous loop of coil antenna (e.g., coil antenna 300) may include at least one exposed loop to form a rectangular ring shaped coil antenna 300. The rectangular ring shaped coil antenna 300 may have the center cutout 302 to implement the coil antenna 300 integration along the plane of the switch 218 without affecting functionality of the switch 218. Furthermore, the coil antenna 300 may be made out of the PCB, FPC, a metal wire, created through a laser direct structuring (LDS) process, or directly printed onto a ferrite material (e.g., ferrite material 314).

At block 610, installing the ferrite material is performed. In an implementation, the coil antenna 300 may be embedded directly to the ferrite material 314 that isolates the coil antenna 300 from a metallic chassis (e.g., metallic chassis 222). The ferrite material 314 may be inserted between the coil antenna 300 and the metallic chassis 222 to protect the coil antenna 300 from Eddy currents that may be induced on the metallic chassis 222, and to block magnetic fields (e.g., magnetic flux 508) from the coil antenna 300 in reaching/penetrating the metallic chassis 222. Furthermore, the ferrite material 314 may be used to guide the magnetic flux 508 in the directions of the magnetic field booster 500 that includes multiple resonant coils.

At block 608, tuning the magnetic field booster is performed. In an implementation, the magnetic field booster 500 may be tuned through by adding and/or removing parasitic reactive components or through NFC module (e.g., NFC module 306) to concentrate magnetic flux (e.g., magnetic flux 508) of the coil antenna 300. In this implementation, the magnetic field booster 500 is tuned to be resonant near operating frequency of the coil antenna 300 to obtain higher equivalent Q when combined with the coil antenna 300.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the various configurations may be implemented as a combined structure or component. These and other variations, modifications, additions, and improvements may fall within the scope of the invention as defined in the claims that follow.

Figure 7:
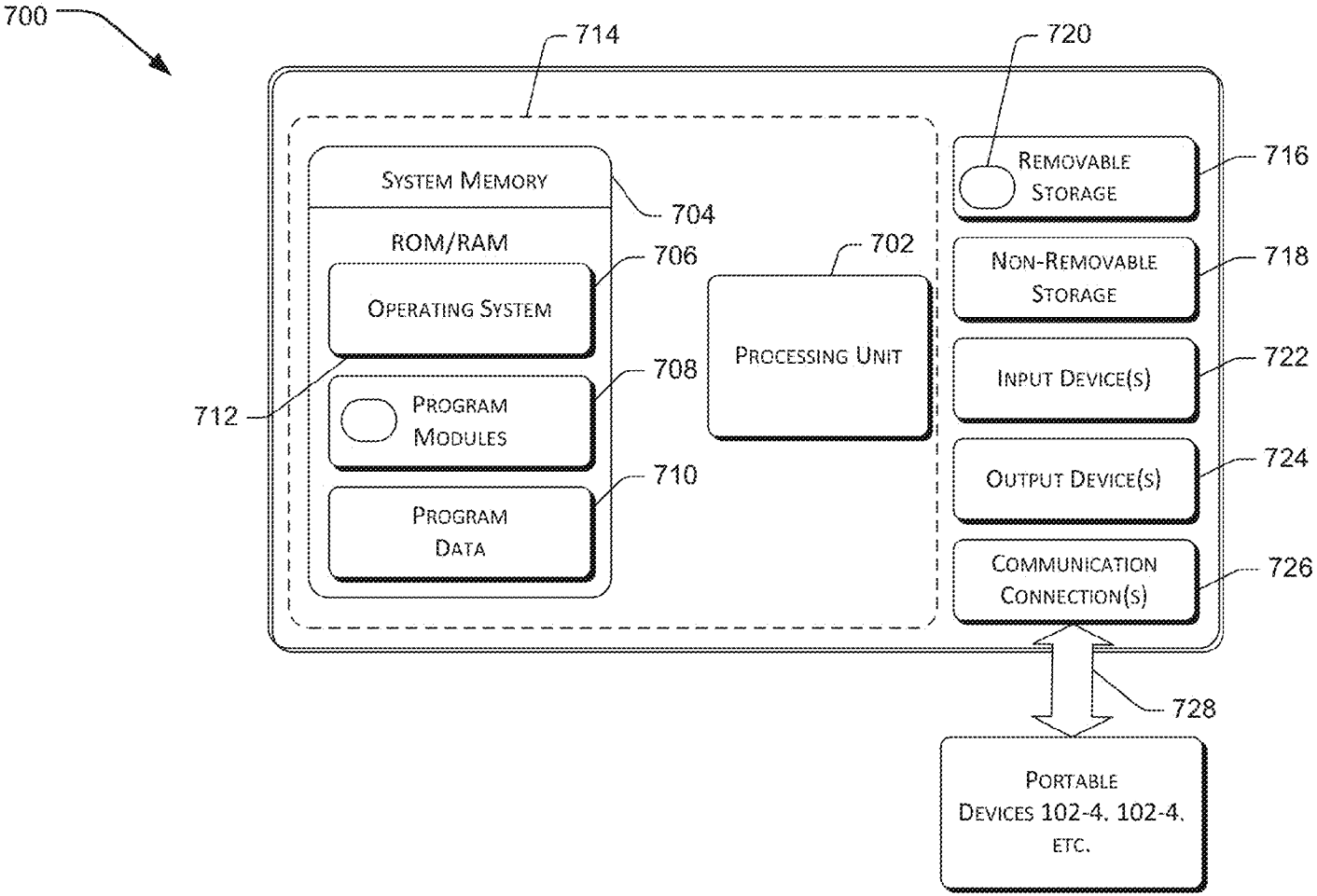
FIG. 7 is an example system that may be utilized to implement various described embodiments.

FIG. 7 is an example system that may be utilized to implement various described embodiments. However, it will be readily appreciated that the techniques disclosed herein may be implemented in other computing devices, systems, and environments. The computing device 700 shown in FIG. 7 is one example of a computing device and is not intended to suggest any limitation as to the scope of use or functionality of the computer and network architectures.

In at least one implementation, computing device 700 typically includes at least one processing unit 702 and system memory 704. Depending on the exact configuration and type of computing device, system memory 704 may be volatile (such as RAM), non-volatile (such as ROM, flash memory, etc.) or some combination thereof. System memory 704 may include an operating system 706, one or more program modules 708 that implement the wireless device architecture 300, and may include program data 710. A basic implementation of the computing device 700 is demarcated by a dashed line 714.

The program module 708 may include a module 712 configured to implement the one-tap connection and synchronization scheme as described above. For example, the module 712 may carry out one or more of the method 600, and variations thereof, e.g., the computing device 700 acting as described above with respect to the portable device 102.

Computing device 700 may have additional features or functionality. For example, computing device 700 may also include additional data storage devices such as removable storage 716 and non-removable storage 718. In certain implementations, the removable storage 716 and non-removable storage 718 are an example of computer accessible media for storing instructions that are executable by the processing unit 702 to perform the various functions described above. Generally, any of the functions described with reference to the figures may be implemented using software, hardware (e.g., fixed logic circuitry) or a combination of these implementations. Program code may be stored in one or more computer accessible media or other computer-readable storage devices. Thus, the processes and components described herein may be implemented by a computer program product. As mentioned above, computer accessible media includes volatile and non-volatile, removable and non-removable media implemented in any method or technology for storage of information, such as computer readable instructions, data structures, program modules, or other data. The terms "computer accessible medium" and "computer accessible media" refer to non-transitory storage devices and include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other non-transitory medium that may be used to store information for access by a computing device, e.g., computing device 700 and portable device 102. Any of such computer accessible media may be part of the computing device 700.

In one implementation, the removable storage 716, which is a computer accessible medium, has a set of instructions 720 stored thereon. When executed by the processing unit 702, the set of instructions 720 cause the processing unit 702 to execute operations, tasks, functions and/or methods as described above, including method 600 and any variations thereof.

Computing device 700 may also include one or more input devices 722 such as keyboard, mouse, pen, voice input device, touch input device, etc. Computing device 700 may additionally include one or more output devices 724 such as a display, speakers, printer, etc.

Computing device 700 may also include one or more communication connections 726 that allow the computing device 700 to communicate wirelessly with one or more other portable devices 102, over wireless connection 728 based on near field communication (NFC), Wi-Fi, Bluetooth, radio frequency (RF), infrared, or a combination thereof. For example, the one or more communication connections 726 include the NFC module 306 and the NFC coil antenna 300.

It is appreciated that the illustrated computing device 700 is one example of a suitable device and is not intended to suggest any limitation as to the scope of use or functionality of the various embodiments described.

Unless the context indicates otherwise, the term "Universal Resource Identifier" as used herein includes any identifier, including a GUID, serial number, or the like.

In the above description of example implementations, for purposes of explanation, specific numbers, materials configurations, and other details are set forth in order to better explain the present invention, as claimed. However, it will be apparent to one skilled in the art that the claimed invention may be practiced using different details than the example ones described herein. In other instances, well-known features are omitted or simplified to clarify the description of the example implementations.

The inventors intend the described example implementations to be primarily examples. The inventors do not intend these example implementations to limit the scope of the appended claims. Rather, the inventors have contemplated that the claimed invention might also be embodied and implemented in other ways, in conjunction with other present or future technologies.

Moreover, the word "example" is used herein to mean serving as an example, instance, or illustration. Any aspect or design described herein as "example" is not necessarily to be construed as preferred or advantageous over other aspects or designs. Rather, use of the word example is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

These processes are illustrated as a collection of blocks in a logical flow graph, which represents a sequence of operations that may be implemented in mechanics alone or a combination with hardware, software, and/or firmware. In the context of software/firmware, the blocks represent instructions stored on one or more computer-readable storage media that, when executed by one or more processors, perform the recited operations.

Note that the order in which the processes are described is not intended to be construed as a limitation, and any number of the described process blocks may be combined in any order to implement the processes or an alternate process. Additionally, individual blocks may be deleted from the processes without departing from the spirit and scope of the subject matter described herein.

The term "computer-readable media" includes computer-storage media. In one embodiment, computer-readable media is non-transitory. For example, computer-storage media may include, but are not limited to, magnetic storage devices (e.g., hard disk, floppy disk, and magnetic strips), optical disks (e.g., compact disk (CD) and digital versatile disk (DVD)), smart cards, flash memory devices (e.g., thumb drive, stick, key drive, and SD cards), and volatile and non-volatile memory (e.g., random access memory (RAM), read-only memory (ROM)).

Unless the context indicates otherwise, the term "logic" used herein includes hardware, software, firmware, circuitry, logic circuitry, integrated circuitry, other electronic components and/or a combination thereof that is suitable to perform the functions described for that logic.

What is claimed is:

1. A portable device comprising:

one or more processors;

a near field communications (NFC) antenna configured to the processors comprising:

a coil antenna that includes at least one exposed coil antenna loop, wherein a cutout at an inner core of the at least one exposed coil antenna loop allows the coil antenna to be integrated onto a surface plane above a circuit board that includes a switch of the plastic keycap, the inner core being aligned with a center point of the multiple resonant coils; and a ferrite material that provides isolation of the coil antenna from metallic components underneath the coil antenna, wherein the ferrite material is inserted between the coil antenna and the circuit board; and a NFC module configured to the NFC antenna to provide tuning adjustment.

2. The portable device of claim 1 further comprising a magnetic field booster that is integrated into a plastic keycap of a keyboard and/or track pad, the magnetic field booster includes multiple resonant coils.

3. The portable device as recited in claim 1, further comprising a magnetic field booster, wherein the magnetic field booster is configured to concentrate magnetic fields generated by the coil antenna for increased NFC range.

4. The portable device as recited in claim 1, further comprising a magnetic field booster, wherein the magnetic field booster includes more number of resonant coil turns than the coil antenna loop that forms the coil antenna.

5. The portable device as recited in claim 1, further comprising a magnetic field booster, wherein the magnetic field booster is tuned by adding and/or removing parasitic reactive components, or by using the NFC module in order to concentrate the magnetic flux of the coil antenna.

6. The portable device as recited in claim 1, wherein the coil antenna includes a rectangular ring shaped coil antenna that is made out of a printed circuit board (PCB), a flexible printed circuit (FPC), a metal wire, created through a laser direct structuring (LDS) process, or directly printed onto the ferrite material.

7. The portable device as recited in claim 1, wherein the coil antenna utilizes a metal-free space clearance underneath the plastic keycap of at least a left touchpad button, a right touchpad button, and/or a middle button of a trackpad.

8. The portable device as recited in claim 1, wherein the coil antenna utilizes a metal-free space clearance underneath the plastic keycap of at least a space key and/or multiple adjacent keys of a keyboard.

9. The portable device as recited in claim 1, wherein the cutout is shaped to utilize metal-free spaces that surround the switch and a spring of the keyboard and/or trackpad.

10. The portable device as recited in claim 1, wherein the coil antenna and the NFC module are integrated to form a single module underneath a metal-free space clearance between trackpad buttons and the circuit board.

11. The portable device as recited in claim 1, wherein the ferrite material protects the coil antenna from Eddy currents that are induced on a metallic chassis, and blocks magnetic fields from the coil antenna.

12. A near field communications (NFC) antenna comprising:

a coil antenna that includes at least one exposed coil antenna loop, wherein a cutout at an inner core of the at least one exposed coil antenna loop allows the coil antenna to be integrated onto a metal-free space clearance underneath a plastic keycap of a keyboard and/or trackpad of a device; and a ferrite material that guides magnetic flux of the coil antenna.

13. The NFC antenna as recited in claim 12 further comprising a magnetic field booster integrated into the plastic keycap, the integrated booster includes multiple resonant coils, wherein the ferrite material guides magnetic flux of the coil antenna to the direction of the multiple resonant coils.

14. The NFC antenna as recited in claim 12, wherein the plastic keycap is fabricated with the integrated magnetic field booster.

15. The NFC antenna as recited in claim 12, further comprising a magnetic field booster, wherein the magnetic field booster is tuned to be resonant near operating frequency to concentrate magnetic fields generated by the coil antenna for improved NFC range.

16. The NFC antenna as recited in claim 12, further comprising a magnetic field booster, wherein the magnetic field booster is independently integrated from the coil antenna and the magnetic field booster includes more number of turns than the coil antenna loop that forms the coil antenna.

17. The NFC antenna as recited in claim 12, wherein the coil antenna includes a rectangular ring shaped coil antenna that is made out of a printed circuit board (PCB), a flexible printed circuit (FPC), a metal wire, created through a laser direct structuring (LDS) process, or directly printed onto the ferrite material.

18. The NFC antenna as recited in claim 12, wherein the coil antenna utilizes the metal-free space clearance underneath the plastic keycap of at least a left touchpad button, a right touchpad button, and/or a middle button of the trackpad.

19. The NFC antenna as recited in claim 12, wherein the coil antenna utilizes the metal-free space clearance underneath the plastic keycap of at least a space key and/or multiple adjacent keys of the keyboard.

20. The NFC antenna as recited in claim 12, wherein the coil antenna includes the center cutout that is shaped to utilize metal free spaces that surround the switch and a spring of the keyboard and/or trackpad.

21. The NFC antenna as recited in claim 12, wherein the ferrite material protects the coil antenna from Eddy currents that are induced on a metallic chassis, and blocks magnetic fields from the coil antenna in penetrating the metallic chassis.

22. The NFC antenna as recited in claim 12, wherein the ferrite material is inserted between the coil antenna, and at least a circuit board or a metallic chassis.

23. A method of integrating a near field communications (NFC) antenna into a host portable device comprising:

constructing an inner core cutout in a coil antenna that includes at least one exposed coil antenna loop;

installing the coil antenna by utilizing a metal-free space clearance underneath the plastic keycap, wherein the inner core cutout allows the installation of the coil antenna underneath the plastic keycap metal-free space clearance; and installing a ferrite material that guides magnetic flux of the coil antenna.

24. The method as recited in claim 23 further comprising integrating a magnetic field booster in the plastic keycap of a trackpad and/or a keyboard, wherein the integrated magnetic field booster includes multiple resonant coils, wherein the magnetic field booster is tuned to concentrate the magnetic flux of the coil antenna.

25. The method as recited in claim 23, further comprising integrating a magnetic field booster, wherein the magnetic field booster is separately integrated and the multiple resonant coils include a greater number of turns than the coil antenna loop that forms the coil antenna.

26. The method as recited in claim 23, further comprising integrating a magnetic field booster that includes multiple resonant coils, wherein the multiple resonant coils is fabricated directly into the plastic keycap.

27. The method as recited in claim 23, further comprising integrating a magnetic field booster that includes multiple resonant coils, wherein the multiple resonant coils are coupled to the coil antenna.

28. The method as recited in claim 23, wherein the coil antenna utilizes the metal-free space clearance underneath the plastic keycap of at least a left touchpad button, a right touchpad button, and/or a middle button of the trackpad.

29. The method as recited in claim 23, wherein the coil antenna utilizes the metal-free space clearance underneath the plastic keycap of at least a space key and/or multiple adjacent keys of the keyboard.

30. The method as recited in claim 23, wherein the coil antenna is connected to an NFC module that is integrated to the coil antenna to form a single module.

31. The method as recited in claim 23, wherein the coil antenna is made out of a printed circuit board (PCB), a flexible printed circuit (FPC), a metal wire, created through a laser direct structuring (LDS) process, or directly printed onto the ferrite material.

32. The method as recited in claim 23, wherein the ferrite material protects the coil antenna from Eddy current that are generated by a metallic chassis in a full metal chassis device.

33. The method as recited in claim 23, wherein tuning of the coil antenna includes configuring a magnetic field booster to be resonant near operating frequency to increase quality factor (Q) of the coil antenna.

* * * * *